United States Patent [19]

Johnson

[11] Patent Number: 4,573,956

[45] Date of Patent: Mar. 4, 1986

[54] SLITTER ASSEMBLY FOR DOUBLE FOLD BOTTOMER APPARATUS

[75] Inventor: Harold K. Johnson, Junction City, Kans.

[73] Assignee: Mid America Machine Corp., Junction City, Kans.

[21] Appl. No.: 530,238

[22] Filed: Sep. 8, 1983

[51] Int. Cl.[4] ..... B21B 1/22

[52] U.S. Cl. ..... 493/237; 493/363; 493/370; 83/54; 83/671; 83/917

[58] Field of Search ..... 493/229, 231, 237, 363, 493/365, 370; 83/54, 176, 917, 671

[56] References Cited

U.S. PATENT DOCUMENTS

| | | | |
|---|---|---|---|
| 3,430,528 | 3/1969 | Eddy et al. | 83/187 |
| 3,446,121 | 5/1969 | Achelpohl | 493/313 |
| 3,913,463 | 10/1975 | Hollis | 493/256 |
| 4,003,300 | 1/1977 | Grobman | 493/365 |
| 4,158,417 | 6/1979 | Inoue | 83/54 |

*Primary Examiner*—Lowell A. Larson
*Assistant Examiner*—Jorji M. Griffin
*Attorney, Agent, or Firm*—Schmidt, Johnson, Hovey & Williams

[57] ABSTRACT

A slitter mechanism for use in a double fold bottomer apparatus employed in making bags from starting flush cut tubes is described which gives precise, high speed side marginal tube slitting in order to permit subsequent downstream gluing and folding operations. In preferred forms, the slitter mechanism includes a bag-end separating assembly having a vacuum manifold and a cooperating adjacent deflector bar serving to separate end portions of the sidewalls of a moving tube. A sequentially rotatable blade is also provided which first enters the open end of the moving tube between separated wall portions, overtakes and slits the leading side margin of the tube, and then stops with a trailing slitting edge situated within the tube open end; subsequent bag movement causes the trailing tube side margin to engage and be slit by the stationary blade edge.

14 Claims, 12 Drawing Figures

Fig. 1
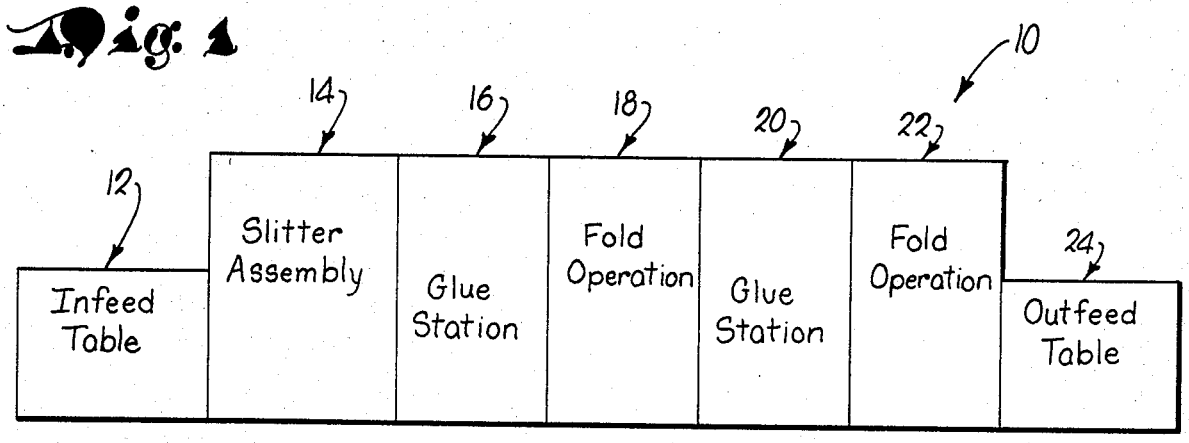
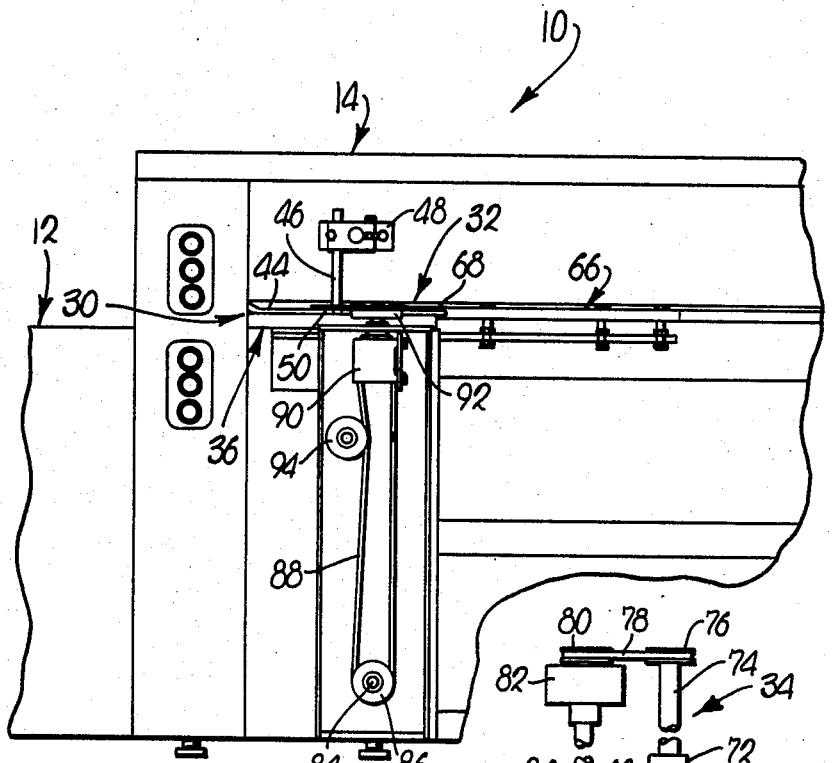
Fig. 2
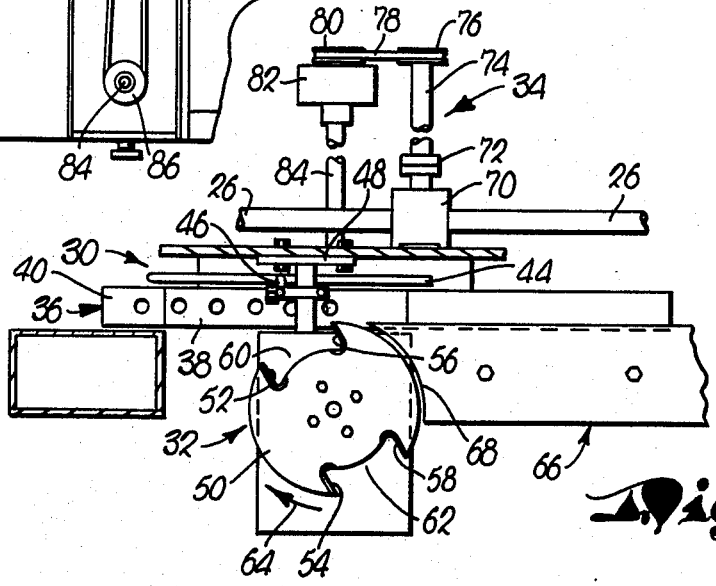
Fig. 3

Fig. 4
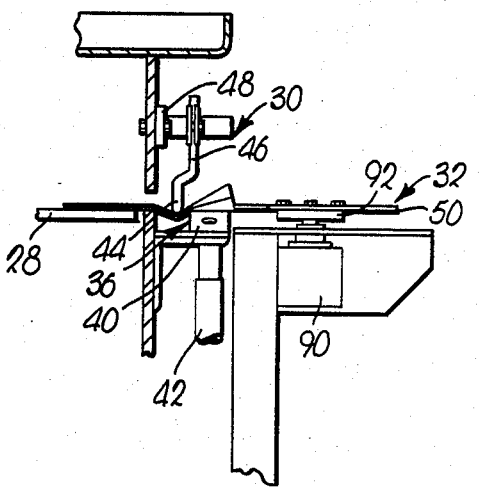
Fig. 5
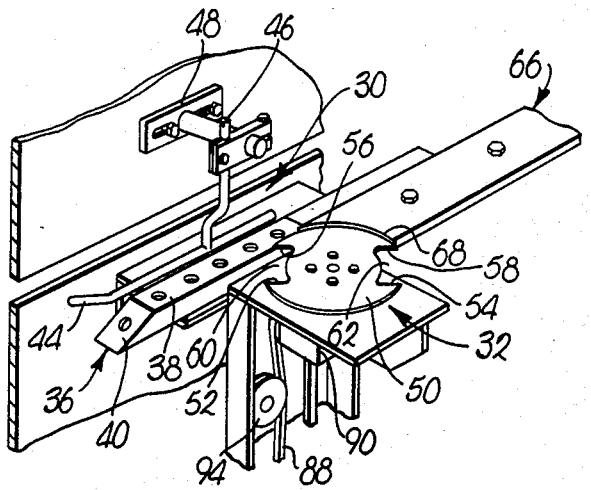
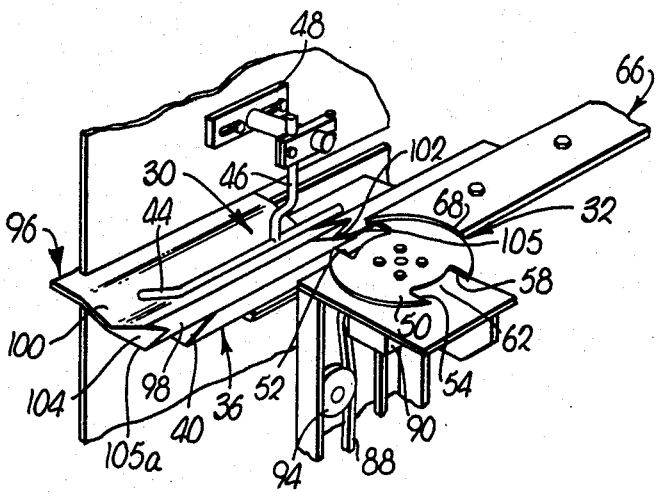
Fig. 6
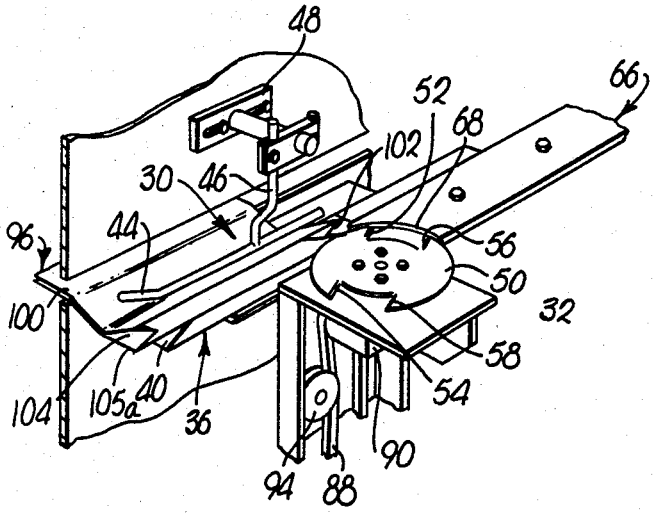
Fig. 7

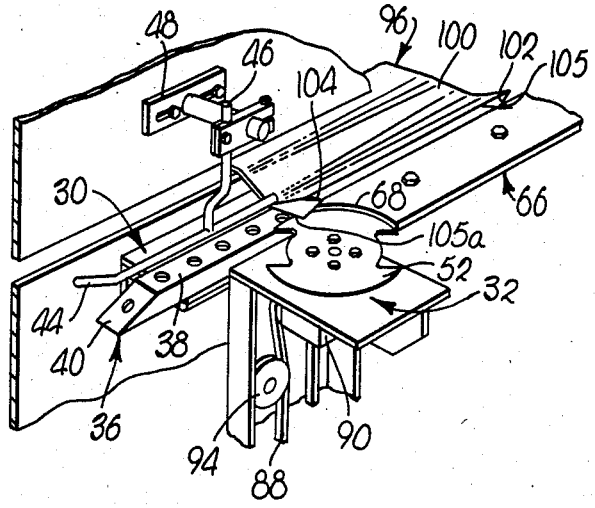
Fig. 8
Fig. 9
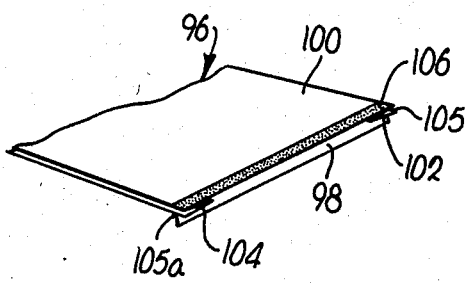
Fig. 10
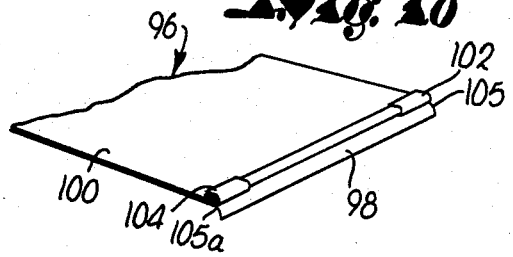
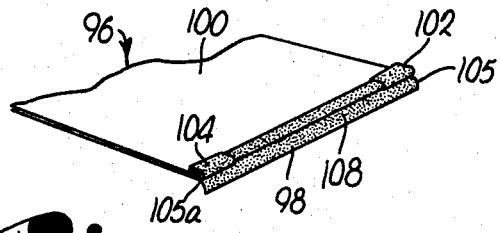
Fig. 11
Fig. 12
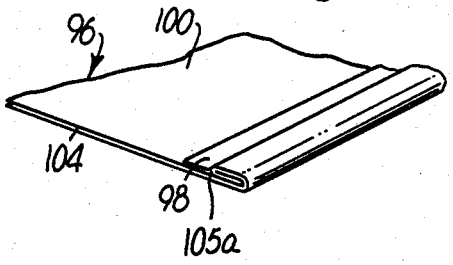

SLITTER ASSEMBLY FOR DOUBLE FOLD BOTTOMER APPARATUS

BACKGROUND OF THE INVENTION

1. Field of the Invention

The present invention is broadly concerned with a slitting mechanism designed for use in a bottomer apparatus especially adapted for creating double fold bag closures of the type described in pending application for U.S. patent Ser. No. 462,026 filed Jan. 28, 1983. More particularly, it is concerned with such a slitter mechanism which provides uniform, high speed, automated marginal end slitting required for subsequent downstream gluing and folding operations in the bottomer apparatus.

2. Description of the Prior Art

A recent, significant advance in the art of container bags is represented by the so-called "double fold" end closure. Such double fold bags, and their methods of manufacture, are disclosed in application for U.S. patent Ser. No. 462,026 filed Jan. 28, 1983, and such application is expressly incorporated by reference herein.

As disclosed in the referenced patent application, the first step in forming a double fold closure end involves providing a pair of short cut lines or slits in the open end of a bag-forming tube, typically at the juncture between a front or rear panel and the side closure panels. Such cut lines can be made either between the front and rear panels proper, or between the plys of one of the panels if the bag-forming tube is of a multiple-ply variety.

Obviously, if double fold closure ends are to become commercially important, the forming of such ends must be accomplished on a high speed, automated basis. While the necessary gluing and folding operations do not present any significant problems in this regard, a real difficulty is presented in connection with providing the necessary side marginal cut lines or slits in the bag-forming tubes. As will be appreciated, any commercially viable slitter mechanism must not only be able to handle many tubes per minute (on the order of 100 or more), but in addition the resulting slits must be of uniform depth and position if the resultant bags and the double fold closures are to be of commercial quality.

SUMMARY OF THE INVENTION

The problems outlined above are solved by the present invention which provides a slitter mechanism forming a part of a double fold bottomer apparatus. Broadly speaking, the slitter mechanism includes means for separating at least certain portions of the end-defining walls of a moving bag-forming tube, along with shiftable slitter means such as a rotatable blade, and means for shifting the slitter means between separated end-defining wall portions and into slitting contact with the tube end.

In preferred forms, the tube end separating means comprises vacuum gripper means presenting a gripping surface situated slightly below the path of travel and adjacent the open end of the tubes for gripping the adjacent sidewall surface of a moving tube proximal to the open end thereof. In addition, an elongated deflector bar is provided which is spaced inwardly of the gripping surface and slightly below the latter, with the gripping surface and bar being cooperatively configured and arranged for spreading and separating portions of the end-defining walls of the tube. In practice, if the bag-forming tube is formed of single ply material (or of multiple plys with the plys being spot pasted together), then the front and rear panels proper of the tube are separated; on the other hand, if the tube is formed of unglued multiple plys, then tube end separation is effected between the outermost ply of the vacuum-gripped panel and the remaining plys of that panel.

The slitter means is preferably in the form of a rotatable slitter blade positioned adjacent the path of travel of the moving tubes and having a pair of circumferentially spaced, elongated, inwardly extending slitting edges. The blade is rotatable in order to initially rotate the leading slitting edge thereof between separated end-defining wall portions of a moving tube, and at a speed such that the leading slitting edge overtakes the leading side margin of the tube and engages and slits the same. In addition, the blade is thereafter further rotated until the trailing slitting edge passes between the separated end-defining wall portions and the trailing edge is positioned for engaging and slitting the trailing side marginal edge of the moving tube. Advantageously, the blade is rotated after the initial slitting operation until the secondary or trailing slitting edge is properly positioned, whereupon the blade is stopped. Further shifting of the tube along its path of travel thus causes the tube to engage and be slit by the stationary slitting edge of the blade. In order to increase the speed of the slitter mechanism, two cooperating pairs of slitter edges are provided on the rotatable blade, so that the blade need be rotated only 180° for each complete slitting operation.

BRIEF DESCRIPTION OF THE DRAWINGS

FIG. 1 is a wholly schematic, side elevational view of a double fold bottomer, the slitter assembly of the present invention forming a part thereof;

FIG. 2 is a fragmentary side view of the slitter mechanism forming a part of the overall bottomer apparatus;

FIG. 3 is a fragmentary, partially schematic top view illustrating the slitter assembly and the drive provided for the slitter blade;

FIG. 4 is a fragmentary vertical sectional view illustrating the construction of the slitter assembly, and with a bag-forming tube illustrated during a typical slitting operation;

FIG. 5 is a fragmentary perspective view of the slitter assembly, shown prior to entrance of a bag-forming tube thereinto, and with the rotatable slitter blade in a stationary position;

FIG. 6 is a view similar to that of FIG. 5, but illustrates a bag-forming tube situated within the slitter assembly prior to the first slitting step, and with the slitter blade being depicted during initial rotation thereof prior to formation of a slit in the leading side margin of the tube;

FIG. 7 is a view similar to that of FIG. 6, but illustrates the bag just subsequent to formation of the initial slit and with the slitter blade still in motion;

FIG. 8 is a view similar to that of FIG. 7, and illustrating the blade in its stopped position with the trailing cutting edge of the blade piercing the trailing side marginal edge of the tube during the secondary slitting operation;

FIG. 9 is an enlarged perspective view of a bag-forming tube, with the tube being slit in the slitter mechanism and an initial glue line applied;

FIG. 10 is a view similar to that of FIG. 9, subsequent to the first folding operation in the bottomer apparatus;

FIG. 11 is a view similar to that of FIG. 10, but illustrates the tube after application of secondary glue in the bottomer apparatus; and FIG. 12 is a view similar to that of FIG. 11, but illustrates the configuration of a completed bag after the secondary folding operation in the bottomer apparatus.

DESCRIPTION OF THE PREFERRED EMBODIMENT

Turning now to the drawings, a bottomer apparatus 10 is schematically depicted in FIG. 1 and is in the form of an elongated, in-line, multiple station device including, in sequential order, an infeed table 12, a slitter assembly 14, an initial glue station 16, an initial folding station 18, a secondary gluing station 20, a secondary folding station 22, and an outfeed table 24. As is conventional in bottomer devices of this type, the respective stations or towers are powered by a common drive line 26 (see FIG. 3) extending along the length of the apparatus. Moreover, successive open ended, bag-forming tubes are fed onto table 12 and are thence moved along the length of apparatus 10 through the respective stations thereof by means of schematically illustrated friction belt assembly 28 (see FIG. 4).

Turning now to FIGS. 2–4, it will be observed that the slitter assembly 14 broadly includes separator means 30 for separating at least certain portions of the end-defining walls of moving tubes, a slitter blade 32, and drive mechanism 34 operatively coupled to blade 32 in order to shift the blade between separated enddefining wall portions of respective moving tubes, and into slitting contact with such tubes.

In more detail, the separating means 30 includes an elongated vacuum manifold bar 36 situated along the path of travel of the tubes and presenting an uppermost, apertured, gripping face 38; the inlet or leading portion of the face 38 being beveled as at 40 to facilitate passage of respective tubes over the bar 36. The manifold bar 36 is conventionally coupled by means of a conduit 42 (see FIG. 4) with an appropriate vacuum pump (not shown).

The overall separating means 30 further include an elongated, metallic, bag-engaging deflector bar 44. It will be noted that the bar 44 is situated inwardly of the gripper bar 36, and slightly below the gripping face 38 of the latter. The bar 44 includes an integral, upstanding leg 46, and a bracket 48 is employed to adjustably hold bar 44 in the proper position.

Slitter blade 32 is in the form of a basically circular, flat metallic body 50 presenting two cooperating pairs of slitting edges 52, 54 and 56, 58. All of the slitting edges are circumferentially spaced about the body 50, are elongated, and extend inwardly from the outer periphery of the body. However, it will further be seen that the edges 52, 54 lie substantially along a common imaginary chord line through body 50, and likewise edges 56, 58 lie along another common imaginary chord line. Further, the edges 52, 56 are in opposed relationship to one another, and are separated by and partially define a relieved region 60; in like manner, the edges 54, 58 are in opposed relationship to one another, are separated by and partially define a relieved region 62.

The direction of rotation of blade 32 as viewed in FIG. 3 is clockwise, i.e., in the direction of arrow 64. Accordingly, it will be seen that, and referring particularly to the edge pair 52, 54, relieved region 60 is in a leading relationship with respect to edge 52 in the direction of rotation of the blade. However, the relieved region 62 is in a trailing relationship with respect to edge 54, again in the direction of rotation of the blade. Similarly, the region 62 is in a leading relationship relative to edge 58, and region 60 is in a trailing relationship with respect to edge 56, in the defined direction of blade rotation.

An elongated, essentially flat separator plate 66 having an arcuate leading edge 68 is positioned just downstream of blade 32 in the path of travel of bag-forming tubes, and serves to maintain the separation effected by the means 30 after the slitting operation is completed. This in turn facilitates the gluing and folding operations accomplished in stations 16–22 as will be explained hereinafter.

The shifting mechanism 34, as noted above, serves to operatively couple main drive line 26 and blade 32. To this end, a right angle gear box 70 is operatively coupled to line 26, and is in turn connected to a flexible coupling 72. An elongated, transversely extending shaft 74 is connected to coupling 72, and has an input timing belt pulley 76 keyed thereto. A timing belt 78 is trained about pulley 76, and also about a somewhat smaller pulley 80. The pulley 80 is operatively connected to a two position clutch 82. The output from clutch 82 is connected to a drive shaft 84, and the latter has a pulley 86 keyed thereto. A timing belt 88 is trained about pulley 86 and is in turn connected to a right angle output gear box 90. The output shaft of gear box 90 is secured to blade 32 through the medium of hub 92. A tensioning pulley 94 is also mounted for engagement with belt 88 between pulley 86 and gear box 90.

Referring now to FIGS. 5–8, the slitting operation of assembly 14 will be described. First, as viewed in FIG. 5, prior to entry of a bag forming tube 96 into the assembly, blade 32 is stationary, no vacuum is being pulled through manifold 36, and deflector bar 44 is positioned as depicted. The tube 96 is of the usual variety and includes a lower tube panel 98, an opposed upper tube panel 100, and respective gusseted sidewall panels 102, 104 interconnecting the panels 98, 100. The tube 96 is flush cut, and presents, during travel through apparatus 10, a leading side marginal edge 105 and a trailing side marginal edge **105*a*. As a tube 96 approaches assembly 14**, the position of the leading side marginal edge of the tube is detected by any conventional means (not shown) such as a photoelectric eye, and such serves to initiate operation of the assembly.

Specifically, and referring to FIG. 6, as the tube 96 enters assembly 14, a vacuum is pulled through bar 36, and blade 32 is rotated in a clockwise direction through the described drive mechanism. In terms of bag end separation, it will be seen (see FIG. 4) that the outermost surface of the lower tube panel 98 is gripped by the bar 36, and that such gripping action, in cooperation with the deflection afforded through the use of bar 44, serves to open the end of the tube 96. In the exemplary showing of FIGS. 4–8, the bag-forming tube 96 is of the single ply variety, and therefore the separation effected by the means 30 is between the lower tube panel 98 and the opposed upper panel 100, with the gusseted side panels 102, 104 being slightly spread as well. However, if a multiple ply tube is employed, then separator means 30 is typically designed to effect separation between the outermost ply of the panel 98 and the adjacent plys making up the panel 98. In either event, an adequate and strong double fold closure is obtained.

Reference is next made to FIG. 7. This Figure depicts the tube 96 further advanced along bar 36 and after the blade edge 52 has engaged and slit the bag at the joinder between gusseted panel 102 and bottom panel 98, i.e., along leading marginal edge 105. In this respect, those skilled in the art will appreciate that inasmuch as edge 52 enters between the separated end-defining wall portions of the tube 96 during movement of the tube, the linear component of rotational speed of the blade during this period must be in excess of the linear speed of the tube 96 in order to "overtake" and slit the leading side marginal edge of the tube; in practice, it has been found that the linear component of velocity of the blade during this period should be on the order of 30% greater than the linear speed of the tube.

When the tube has been slit as depicted in FIG. 7, the upper portion of the tube (i.e., gusseted side panel 102 and upper panel 100) pass over plate 66, whereas lower panel 98 passes beneath the plate 66. This serves to maintain the separation between end defining panel portions as the tube 96 proceeds along its path of travel and prior to any gluing or folding operations.

After the initial slitting operation depicted in FIG. 7 is completed, the blade 32 continues to rotate until blade 54 assumes the position illustrated in FIG. 8, and at this point the blade is stopped. When the blade is stopped, the edge 54 is located within the separated open end of the tube, and is in position for slitting the trailing side marginal edge 105*a* of the tube. FIG. 8 illustrates this secondary slitting operation, with the blade 32 bing stationary.

FIGS. 9–12 illustrate the configuration of tube 96 downstream of the mechanism 14, as the tube is manipulated in stations 16–22. Specifically, FIG. 9 illustrates the condition of tube 96 after application of a first glue line 106 across the transverse marginal edge of upper panel 100; in addition, the slits or cut lines formed in the tube 96 are evident in FIG. 9.

FIG. 10 illustrates the condition of tube 96 after the first folding operation, i.e., after the upper portion of the tube 96 above the cut lines is folded upon itself.

FIG. 11 shows the next sequential stage in bag-forming operations in the overall bottomer apparatus, when a secondary glue line is applied over the exposed faces of the folded over portion of the bag, and the exposed tab or flap portion therebeneath. This secondary glue line is referred to by the numeral 108 in FIG. 11.

FIG. 12 illustrates the condition of the tube 96 after the secondary folding operation, i.e., after the glued portion of the tube depicted in FIG. 11 is folded upwardly and into contact with the upper face of panel 100. This creates a bottom closure for the tube, thereby creating a bag. The so formed bags are then fed to outfeed table 24, for ultimate filling and use.

Although the respective glue and folding stations have been illustrated only schematically in the drawings, those skilled in the art will recognize that these operations in a bottomer apparatus require only conventional hardware and design considerations; accordingly, detailed depiction and explanation of the gluing and folding devices forming a part of the overall bottomer apparatus would be superfluous and is omitted.

I claim:

1. A slitter mechanism for slitting the defining walls of the open end of an unfilled tube or the like, said mechanism comprising:

means for continuously moving said unfilled tube along a path of travel;

means adjacent said path of travel for separating at least certain portions of said end-defining walls of said continuously moving tube;

slitter means proximal to said separating means and including a pair of respective, spaced apart slitting edges; and shifting means operably coupled with said slitter means for forming a pair of independent, spaced apart slits in said unfilled tube at respective spaced apart slitting locations while the tube is continuously moving along said path of travel, said shifting means including means for moving each of said slitting edges between said separated end-defining wall portions and into slitting engagement with the unfilled tube at a corresponding respective slitting location.

2. The mechanism of claim 1, said separating means including:

vacuum gripper means presenting a gripping surface along said path of travel of said tube and adjacent the open end thereof; and deflector means postioned adjacent and in laterally and vertically offset relationship to said gripping surface, said gripping surface and deflector means being cooperatively configured and arranged for said separation of portions of the end-defining walls of said tube moving therepast.

3. The mechanism of claim 2, said defector means having a bag-engaging surface situated slightly below said gripping surface.

4. The mechanism of claim 1, said slitter means including a rotatable blade presenting said slitting edges and shifting means including structure for rotation of said blade in order to cause said edges to pass between said end-defining wall portions and thence into slitting engagement with said tube end at said corresponding respective slitting locations.

5. The mechanism of claim 4, said blade-rotating structure being constructed and arranged such that one of said edges is shifted relative to said tube at a speed in excess of the speed of the tube in order to overtake and slit the leading side margin of said tube at one of said respective slitting locations.

6. The mechanism of claim 4, said rotatable blade presenting a pair of circumferentially spaced, elongated, inwardly extending slitting edges, said blade-rotating structure including means for initially rotating said blade in order to cause a leading slitting edge to pass between said end-defining wall portions and thence into slitting engagement with the leading side margin of said moving tube, and for thereafter further rotating said blade until the trailing edge passes between said end-defining wall portions and a trailing slitting edge is positioned for engaging and slitting the trailing side margin of the moving tube.

7. The mechanism of claim 6, said blade-rotating structure including means for stopping said blade rotation when said trailing edge reaches said position.

8. The mechanism of claim 1, including an elongated separation element positioned adjacent said separating means and downstream therefrom along said path of travel for maintaining the separation between said end defining wall portions after slitting thereof.

9. The mechanism as defined in claim 1, said slitter means including a unitary blade, said unitary blade including said pair of respective, spaced apart slitting edges.

10. A slitter mechanism for slitting the defining walls of the open end of a bag-forming tube or the like moving along a path of travel, said mechanism comprising:

means for separating at least certain portions of said end-defining walls of said moving tube, including vacuum gripper means presenting a gripping surface situated slightly below said path of travel and adjacent the open end of said tube for gripping of the adjacent sidewall surface of said tube proximal to the open end of the tube; and an elongated deflector bar spaced inwardly of said gripping surface and slightly below the latter, said gripping surface and bar being cooperatively configured and arranged for said bag end separation;

a rotatable slitter blade adjacent said path of travel having a pair of circumferentially spaced, elongated, inwardly extending slitting edges;

means for rotating said blade in order to initially rotate the leading edge thereof between the separated end-defining wall portions and at a speed such that said leading edge overtakes the leading side margin of said tube and engages and slits said leading side margin, and for thereafter further rotating said blade until the trailing edge thereof passes between said separated end-defining wall portions and said trailing edge is positioned for engaging and slitting the trailing side marginal edge of the moving tube.

11. The mechanism of claim 10, said blade-rotating means including means for stopping said blade rotation when said trailing slitting edge reaches said position thereof.

12. The mechanism of claim 10, including plate means immediately downstream of said blade along said path of travel for maintaining the slitted, end-defining wall portions of said moving bag in a separated condition.

13. A slitter mechanism for slitting the defining walls of the open end of a tube or the like moving along a path of travel, said mechanism comprising:

means adjacent said path of travel for separating at least certain portions of said end-defining walls of said moving tube;

slitter means proximal to said separating means;

means operably coupled with said slitter means for shifting said slitter means between said spearated end-defining wall portions and into slitting contact with said tube end, said slitter means including a rotatable blade presenting a pair of circumferentially spaced, elongated, inwardly extending slitting edges, said shifting means including structure for rotation of said blade in order to cause said edges to pass between said end-defining wall portions and thence into slitting engagement with said tube end, said blade-rotating structure including means for initially rotating said blade in order to cause the leading edge to pass between said end-defining wall portions, and move at a speed in excess of the speed of the tube so as to come into slitting engagement with the leading side margin of said moving tube, and for thereafter further rotating said blade until the trailing edge passes between said end-defining wall portions and said trailing edge is positioned for engaging and slitting the trailing side margin of the moving tube.

14. A slitter mechanism for slitting the defining walls of the open end of a tube or the like comprising a pair of opposed walls, each of said walls having a plurality of facially opposed plies, said mechanism comprising:

means for moving said tube along a path of travel and through a slitting station;

means adjacent said path of travel for creating a separation between a pair of said plies of one of said bag walls and adjacent said open end of said tube as said tube passes through said slitting station, slitter means proximal to said separating means; and means operably coupled with said slitter means for shifting said slitter means between said separated plies of said one bag wall and into slitting contact with said open end of said tube as said tube passes through said slitting station.

* * * * *